US005546887A

United States Patent [19]

Cameron

[11] Patent Number: 5,546,887

[45] Date of Patent: Aug. 20, 1996

[54] EMERGENCY WHISTLE

[76] Inventor: Robert W. Cameron, 4972 Northwest Rd., Bellingham, Wash. 98226

[21] Appl. No.: 224,508

[22] Filed: Apr. 7, 1994

[51] Int. Cl.[6] ..... G10K 5/00

[52] U.S. Cl. ..... 116/137 R

[58] Field of Search ..... 116/137 R, 141; 446/204, 205, 206

[56] References Cited

U.S. PATENT DOCUMENTS

| | | | |
|---|---|---|---|
| 2,454,105 | 11/1948 | Thompson | 46/206 |
| 4,709,651 | 12/1987 | Lance | 116/137 R |
| 4,821,670 | 4/1989 | Foxcroft et al. | 116/137 R |
| 5,086,726 | 2/1992 | Sharp | 116/137 R |

FOREIGN PATENT DOCUMENTS

| | | | |
|---|---|---|---|
| 1309168 | 10/1962 | France | 116/137 R |
| 6804 | of 1893 | United Kingdom | 446/204 |
| 20820 | 11/1900 | United Kingdom | 446/204 |
| 315624 | 7/1929 | United Kingdom | 446/205 |

*Primary Examiner*—Thomas B. Will
*Assistant Examiner*—Willie Morris Worth
*Attorney, Agent, or Firm*—Todd N. Hathaway

[57] ABSTRACT

An emergency signalling whistle which simultaneously emits high- and low-pitched whistle tones so as to be detectable from relatively long distances and localizable from relatively short distances. A mouthpiece contains first and second air passages which discharge across openings into chambers of different sizes. The whistle also incorporates cylindrically concave grip surfaces which align with the ends of the person's thumb and forefinger in the grip position. In addition, there is an enlarged flange at the end of the mouthpiece which is retained in the person's mouth by the incisor teeth, and a second flange around the mouthpiece which forms a seal against the outer surface of the person's lips.

13 Claims, 2 Drawing Sheets

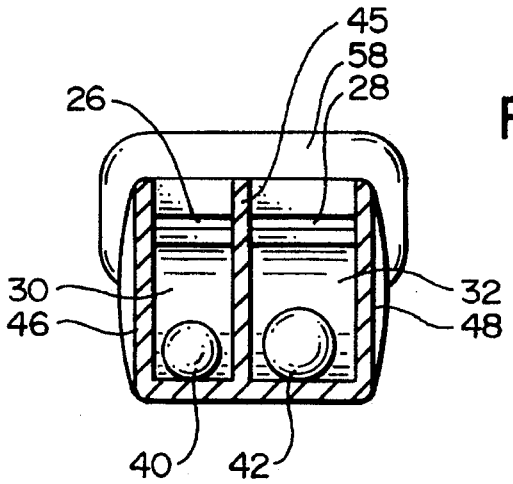
FIG. 4
FIG. 5
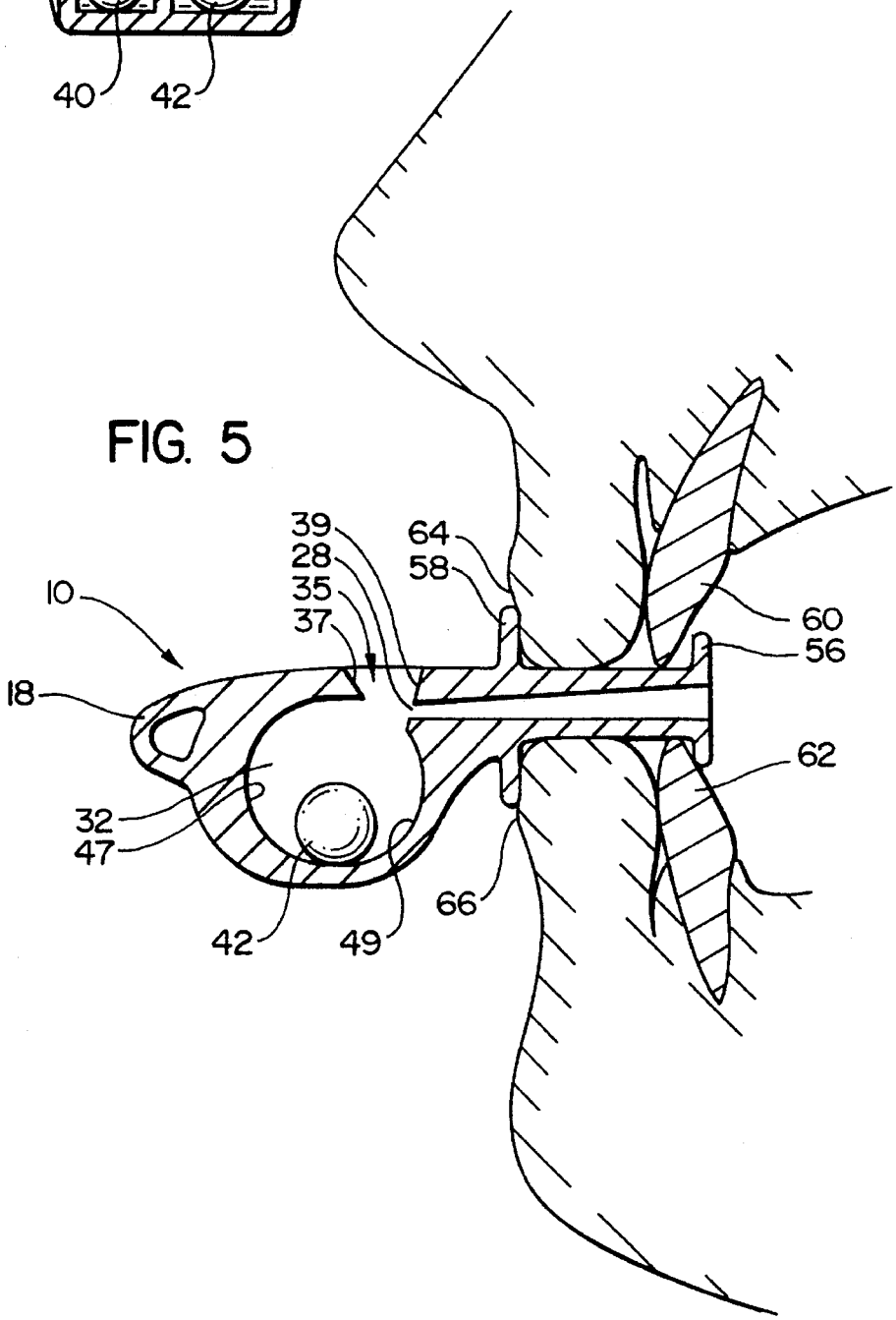

EMERGENCY WHISTLE

BACKGROUND OF THE INVENTION

1. Field of the Invention

The present invention relates generally to emergency signaling devices, and more particularly to a safety whistle which can be blown to help locate a person in distress.

2. Background Art

Mouth blown whistles are an effective tool for helping to locate a person in an emergency. For example, sportsmen are well advised to carry a whistle in order to aid searchers in the event they become lost in a wilderness or on a body of water.

Traditional whistles have proven reasonably effective for this purpose. For example, the traditional "Thunderer" style whistle, which holds a cork pea in a chamber at the end of an air passage, produces a strong, clear note with a "warbling" effect which helps draw attention. Nevertheless, these traditional devices are not without their deficiencies.

Firstly, traditional whistles emit only a single tone, which is not ideal in many emergency scenarios. For example, it is well known that high-pitched tones are generally easier for people to localize, but they do not carry well over long distances. Lower-pitched tones by contrast, are generally perceptible at longer distances, but it is difficult for the human ear to determine the actual location of their source. This deficiency can be critical in real world situations: for example, a person lost in the woods or on a body of water may initially be a significant distance from rescuers, so that a high-pitched tone would not reach them; however, when the searchers are closer, higher tones are needed to help them localize the source quickly.

In addition, traditional whistles are not well adapted in terms of structure for use in the hostile and often severe environments in which emergencies frequently occur. For example, traditional whistles are typically meant to be held to the mouth by a hand, but a person who is using their arms to stay afloat will be unable to do this. Even if the person has their hands free, wet or extreme cold may severely impair their ability to grip the device; for example, in severe cold the person will either be wearing heavy gloves, which will impair achieving any sort of grip, or else their hands will tend to become so numb and stiff as to be virtually useless.

Moreover, hostile environmental conditions may also make it difficult to effectively blow air through a whistle. In particular, severe cold and/or fatigue can make it very difficult for a person to seal their lips around a mouthpiece, with the result that much of the air escapes uselessly. Similarly, a person who has been gasping for air, as when trying to stay afloat, will find it difficult to hold the device in their mouth, and to form an effective seal between breaths. The severity of this problem is aggravated by the fact that it is often essential for the person to blow the whistle continuously and without interruption if there is to be any hope of rescue, as, for example, when a person is lost overboard at night or in a fog and therefore cannot know whether rescue boats are near.

Accordingly, there exists a need for a whistle which can emit tones at both high and low pitches, so as to facilitate the detection of persons in distress from relatively long distances, and the localization of such persons by searchers closer to the scene. Moreover, there is a need for such a whistle which is easy to grip with impaired hands, and which may in fact be held in the mouth without the aid of one's hands. Still further, there exists a need for such a whistle which a a person can correctly position in his mouth and form an effective lip seal therewith, even under conditions of severe cold, wet, and fatigue.

SUMMARY OF THE INVENTION

The present invention has solved the problems cited above, and is an emergency signalling whistle comprising a mouthpiece portion configured to be gripped in a person's mouth, first and second air passages formed in the mouthpiece portion for receiving air which is blown from the person's mouth, and means associated with the air passages for simultaneously generating (a) a whistle tone having a first pitch in response to passage of the air through the first air passage, and (b) a whistle tone having a second pitch in response to the passage of the air through the second air passage, the first pitch being relatively lower so as to enable the whistle to be heard by persons at relatively long distances, and the second pitch being relatively higher so as to enable the whistle to be localized by persons at relatively short distances.

The means associated with the air passages for simultaneously generating the two whistle tones may comprise an exit slot at an end of each air passage, and first and second chambers mounted to the mouthpiece portions and having openings across which the air from the exit slots is directed so as produce the whistle tones, the first chamber being relatively larger so as to produce the relatively lower first pitch, and the second chamber being relatively smaller so as to produce the relatively higher second pitch.

The first and second chambers may be generally barrel-shaped and mounted in end-to-end relationship at the ends of the air passages, each chamber having its opening formed at an edge thereof. There may be a pea member received in each chamber for imparting a warbling character to the tone which is produced thereby, the pea in the first chamber being sized relatively larger than that in the second chamber.

The mouthpiece portion of the whistle may further comprise a first outwardly extending flange portion for forming a substantially airtight seal against the outer surface of a person's lips, which flange portion may extend annularly completely around the mouthpiece.

The mouthpiece potion may further comprise a second outwardly extending flange portion which is positioned proximate an outer end thereof for engaging the inner surfaces of the person's incisor teeth, the second flange portion being spaced a predetermined distance from the first such that the latter is pressed against the outer surface of the person's lips so as to form the seal therewith in response to the second flange portion being held in the person's teeth.

The chambers which are mounted in end-to-end relationship may have outer end walls which are configured to be gripped between the person's fingers. These may have concave grip surfaces which are generally cylindrically dished about axes which extend in roughly vertical directions when the mouthpiece is gripped in the person's mouth, so that the cylindrically concave grip surfaces are generally aligned with the distal phalanges of the thumb and a finger when the whistle is gripped in the person's mouth and hand. The grip surfaces may be provided with coarse surface texturing for enhancing the grip which is offered thereby.

BRIEF DESCRIPTION OF THE DRAWINGS

FIG. 4 is a sectional view, taken along line 4—4 in FIG. 2, showing an end view of the dual chambers at the ends of the air passages through the mouthpiece; and FIG. 5 is a sectional view taken longitudinally through the whistle of FIGS. 1–3 and the lips and forejaws of a person having the whistle gripped therein so as to form an effective seal with the mouthpiece.

DETAILED DESCRIPTION a. Dual-pitch Structure

Figure 1:
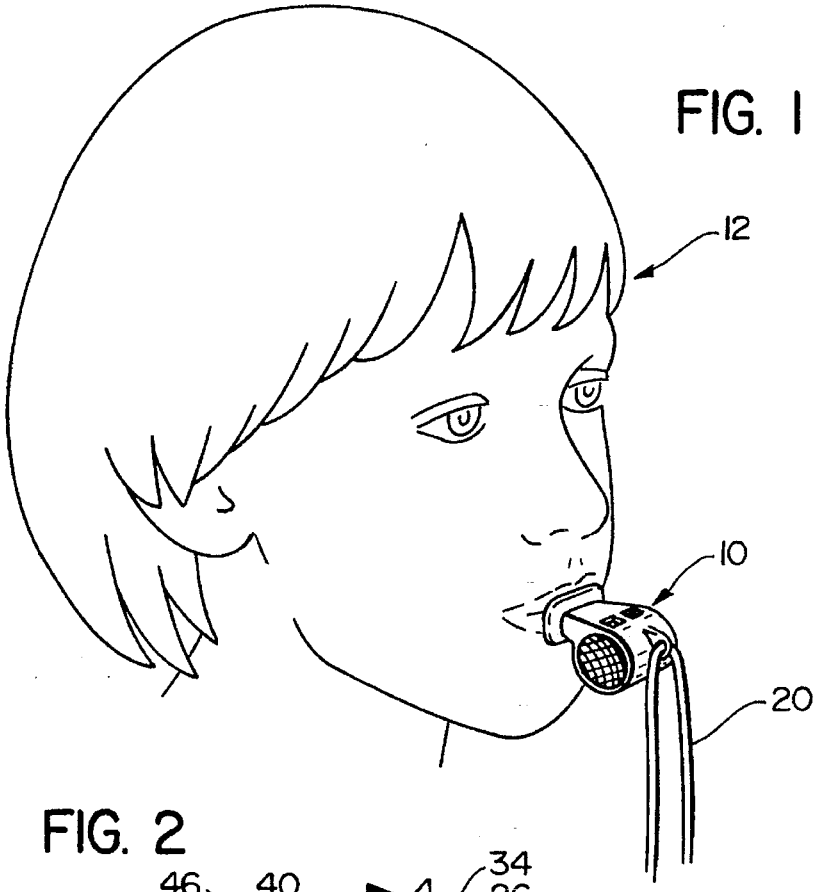
FIG. 1 is a perspective view of a whistle in accordance with the present invention positioned in a person's mouth for operation.
Figure 2:
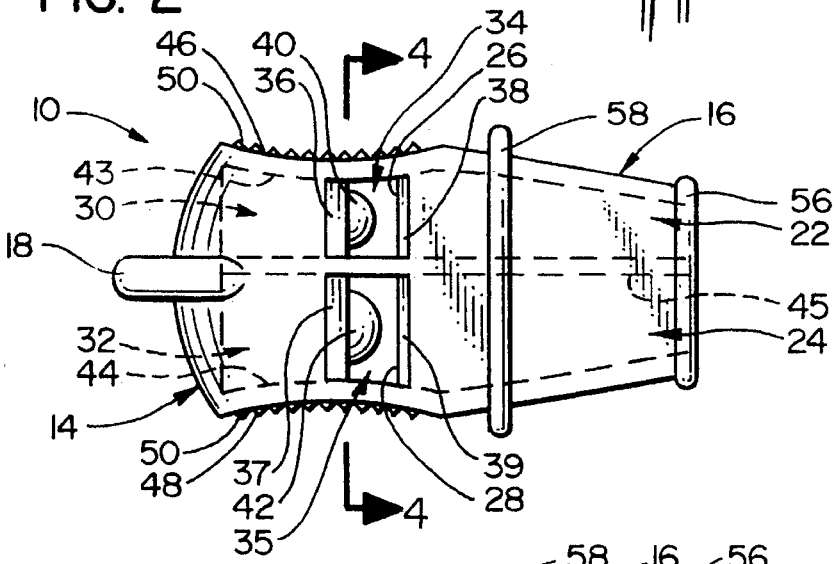
FIG. 2 is a plan view of the whistle of FIG. 1, showing the side-by-side barrels thereof which produce whistle tones of different pitch.
Figure 3:
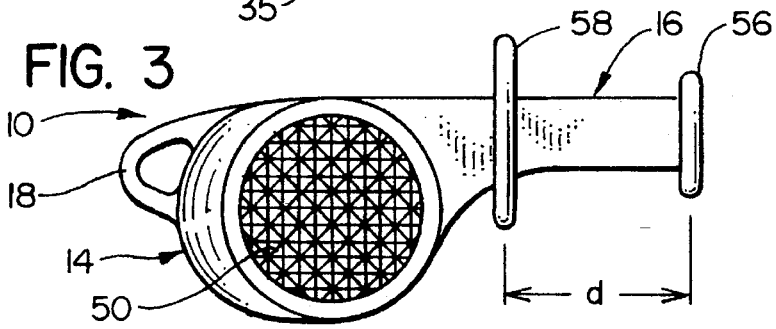
FIG. 3 is an elevational view of the whistle of FIGS. 1–2, showing the lip seal and finger grip structures in greater detail.

FIG. 1. shows a whistle 10 in accordance with the present invention positioned in the mouth of a person 12 so that they can blow through it and emit an audible signal. As will be described in greater detail below, the whistle simultaneously emits both high- and low-pitched tones which enable searchers to first locate it from a relatively long distance, and then localize the source as they draw closer. As can be seen in FIGS. 2–3, the whistle 10 somewhat resembles a traditional whistle externally, in that this comprises generally a drum-shaped body portion 14 from which a tapered mouthpiece 16 extends, the body portion also having a forwardly projecting loop 18 for receiving a carrying lanyard 20 (see FIG. 1). The body portion and mouthpiece portions may be formed unitarily of any suitable material, such as injection molded plastic. Furthermore, fluorescent, photoluminescent, or reflective materials may be used in the construction of the whistle, or decals or labels therefor, so as to increase the visibility of the device for the benefit of both the user and search personnel.

By contrast with traditional whistles, however, the interior of whistle 10 is provided with first and second, side-by-side air passages 22, 24. As can be seen in FIG. 5, the air passages preferably taper somewhat, in the direction away from the person's mouth. In plan view, however, the air passages widen outwardly from the entrance opening, as the overall width of the mouthpiece itself increases.

The air from the person's mouth travels through both air passages and escapes through slots 26, 28 at the ends thereof across openings 34, 35 formed at the edges of chambers 30, 32 so as to produce the desired whistle tones. In an exemplary embodiment, a vertical gap of about 0.040" has been found to be suitable for the slots 26, 28, with the gap across which the air is directed being approximately 0.310" at the top. As will be described below, the chambers are preferably oval in shape, with first and second radii of about 0.348" and at a spacing of approximately 0.084" having been found suitable for the exemplary embodiment.

Forward ramp portions 36, 37 are formed at the edges of the openings opposite slots 26, 28, these being sloped at a suitable angle so as to direct a portion of the air flow into the chambers, and there are also rearward ramp portions 38, 39 formed above the air slots; a slope of about 40 degrees and 20 degrees from vertical, respectively, has been found suitable for the forward and rearward ramps in a whistle having the exemplary dimensions noted above.

The chambers 30, 32 are generally barrel shaped (i.e., roughly the shape of an oval cylinder) so that the air flows along a generally circular or oval path therein. Each chamber contains a pea 40, 42, which is formed of cork, rubber, plastic, or other suitable material. Thus, as the air is forced into the chambers, the peas are caused to rotate past the openings 34, 36, imparting a warbling quality to the whistle tones; this warbling or "staccato" quality is important in emergency situations, because without it the sound tends to blend with and be lost in the whistling of the wind. The smaller pea 40 imparts a relatively rapid, shrill staccato to the higher note, while the larger pea 42 gives the lower note a deeper rumbling or "thundering" quality.

As can be seen in FIG. 2, and also in FIG. 4, the two chambers 30, 32 and their respective air passages are sized differently, one being generally wider than the other; in the exemplary embodiment having the dimensions given above, a first chamber 30 having an internal width of about of 0.40" and a second chamber 32 having an internal width of about 0.50" have been found suitable. Inasmuch as the chambers are essentially similar in cross-section, this difference in width translates to a difference in volumes. As a result, the smaller chamber 30 produces a relatively higher-pitched tone, while the larger chamber produces a tone having a significantly lower pitch. For the reasons discussed above, this lower-pitched tone can be detected by people over relatively greater distances, while the higher-pitched tone assists them in localizing the source.

As was noted above and as can be seen in FIG. 5, the chambers 30, 32 are not precisely circular in cross-section, but are generally oval instead, having cupped forward and rearward walls 43, 44. These are configured to reflect the sound waves within the chambers, increasing the acoustic efficiency thereof and producing a louder blast than would normally be produced by a circular chamber under the same conditions.

The acoustic performance of the whistle is further enhanced by the configuration of the end walls 47, 49 of the chambers 30, 32. As will be discussed in greater detail below, the outer surfaces of these walls are cylindrically concave so as to offer an enhanced grip for the user's fingers. Their inner surfaces, in turn, are cylindrically convex, and as the peas rotate past these, the shape and effective volume of the acoustic chamber vary somewhat, with the result that a relatively full spectrum of sound is produced. Also, as the peas pass the "humps" in the walls, the width of the air passage is constricted somewhat, so that the brief, localized increase in air pressure which develops behind the pea causes it to accelerate twice during each rotation through the chamber; in practice, it has been found that this makes it possible to achieve a loud, sharp staccato note without having to blow as hard as is required with traditional designs. Also, the peas tend to bounce off of the "humps" in the walls, with the resultant increased rattling of the peas enhancing the staccato effect.

FIGS. 2 and 4 show all of the elements of the lower-pitched side of the whistle being sized larger than those on the higher-pitched side. In addition to the acoustic benefits, this configuration is advantageous because it has been found economical to manufacture the device with a simple longitudinal divider wall 45 which is positioned off-center within the symmetrical body and mouthpiece to define the two sides of the whistle. However, it may be desirable in some embodiments to obtain the higher and lower pitches by adjusting the size of certain elements (e.g., chamber size) or their positions, while leaving others (e.g., pea size) constant.

b. Enhanced Hand Grip Structure

By virtue of the end-to-end transverse placement of the dual chambers 30, 32, as shown in FIG. 2, the barrel shaped body portion 14 of the whistle is rendered relatively wide, this alone making it somewhat easier for a person to grip the device with a numb or gloved hand. Moreover, the outer sidewalls 43, 44 of the body portion 14 are dished-in to form concave grip surfaces 46, 48. The grip surfaces are preferably generally semi-cylindrical in shape, with respect to axes which extend in roughly vertical directions when the device is received in a person's mouth as shown in FIG. 1. This configuration is important because it aligns the concave grip surfaces 46, 48 with the natural orientation of the distal phalanges of the thumb and a finger when the person's hand is curled to grip the device and hold it to the person's mouth. This greatly enhances the available grip surface and also the ability of a person to apply pressure to this with a numb or heavily gloved hand, as compared, for example, to a spherically dished surface which tends to be gripped by pressure which is applied axially between the fingertips.

So as to still further enhance the grip which is offered by the device, the concave grip surfaces 46, 48 are provided with heavy surface texturing 50. In the embodiment which is illustrated in FIG. 3, the surface texturing is in a coarse diamond pattern, which not only offers a superior grip, but also reduces the problem of clogging by mud or snow.

c. Mouth Retainer/lip Seal Structure

As can be seen in FIGS. 2–3, the mouthpiece 16 of the whistle is provided with a structure which enhances the ability of a person to establish an effective mouth grip and lip seal therewith. In particular, there is a relatively large retainer flange 56 which extends around the end of the mouthpiece, and a somewhat larger lip seal flange 58 which extends around the mouthpiece a spaced distance "d" from the retainer flange.

As can be seen in FIG. 5, the retainer flange 56 is configured to engage the inner surfaces of the person's incisors 60, 62, and is sufficiently large that the person can retain the whistle in their mouth without the aid of their hands, even if their jaws are somewhat slack or partially open from fatigue or heavy breathing. This is to be contrasted with traditional whistle designs which are intended to be gripped in the mouth (if at all) by keeping a firm bite on the mouthpiece, which is simply not possible for persons to maintain over an extended period.

The lip seal flange 58, in turn, engages the outer surfaces of the upper and lower lips 64, 66 so as to form a substantially airtight seal therewith, all around the mouthpiece. The spacing "d" between the seal and retainer flanges (see FIG. 3) is selected so that, when held in the mouth by persons having normally sized and shaped mouth structures, there is a slight pressure of the lip seal flange 58 against the outer surfaces of the lips so as to enhance the seal.

The fact that the whistle is thus easily held in the mouth with an effective seal being formed against the lips also makes it possible for a person to breathe through the device. This is particularly advantageous in those situations where it is necessary for the person to blow the whistle continuously. Also, if the person is trying to stay afloat in water which sometimes passes over his head, the device will prevent the water from entering the person's mouth directly, and any water which enters the whistle can be cleared simply by blowing through it.

The annular lip seal flange may vary somewhat in size and shape from that which is illustrated, in that in many embodiments it may be somewhat larger and may also be contoured to conform to the shape of the person's lips. Also, it may desirable in some cases to form the flange of a somewhat flexible material so as to further enhance the seal. Still further, in some embodiments the flange may extend around the mouthpiece in certain areas (e.g., along the top), but not in other areas, depending on where it has been determined that there is particular a need to prevent air loss.

Therefore, having described the present invention in its preferred embodiments, it will be understood that many changes and variations made thereto without departing from the basic spirit thereof. For example, if desired, the whistle can be configured to have three or more air passages with associated chambers and other elements to provide three or more pitches, rather than two which have been illustrated. Also, as was noted above, the shape and size of the tooth engagement and lip seal flanges may be modified somewhat from those which are shown, as may be desired for a particular application. Still further, the whistle may be formed of any of a wide range of suitable materials, such as various metals for example. It is therefore not intended that the words used to describe the invention nor the drawings illustrating the same be limiting thereon; rather, it is intended that the invention be limited only by the scope of the following claims.

What is claimed is:

1. An emergency signaling whistle comprising:

a mouthpiece portion configured to be held by a person's incisors, said mouthpiece portion comprising:

a first flange portion which extends outwardly around said mouthpiece portion such that a person's lips may form a substantially air-tight pressure seal against said first flange portion; and a second flange portion which extends at least upwardly and downwardly from an outer end of said mouthpiece portion by a sufficient distance to allow inwardly sloping inner surfaces of a person's incisors to engage said second flange portion without the need for fully clamping a person's incisors against said mouthpiece portion;

said second flange portion being spaced from said first flange portion by a predetermined distance such that a person's lips may seal against said first flange portion in response to said second flange portion being engaged by a person's incisors;

whereby said mouthpiece portion is held in a person's mouth with lips sealed against said first flange portion without using one's hands;

first and second air passages formed in said mouthpiece portion for receiving air which is blown from a person's mouth;

means associated with said first air passage for generating a whistle tone having a first pitch in response to flow of said air through said first passage, and means associated with said second air passage for generating a whistle tone having second pitch in response to flow of said air through said second passage;

said first pitch being relatively low so as to enable said whistle to be heard by persons at relatively long distances and said second pitch being relatively high so as to enable said whistle to be localized by persons at relatively short distances.

2. The emergency signalling whistle of claim 1, wherein each said means associated with said air passages for generating said whistle tones comprises:

an exit slot at an end of said air passage; and a chamber mounted to said mouthpiece portion and having an opening across which said air from said exit slot is directed to produce said whistle tone;

a first chamber which is associated with said first passage being relatively larger so as to produce said whistle tone having said relatively lower first pitch, and a second chamber which is associated with said second passage being relatively smaller so as to produce said whistle tone having said relatively higher second pitch.

3. The emergency signalling whistle of claim 2, wherein said first and second chambers are each generally barrel shaped and are mounted transversely in end-to-end relationship at said ends of said air passages, said opening being formed along an edge of each said barrel-shaped chamber so that a portion of said air flowing through said passages enters therein.

4. The emergency signalling whistle of claim 3, further comprising:

a pea member received in each said barrel-shaped chamber for imparting a warble to said whistle tone which is produced by said chamber.

5. The emergency signaling whistle of claim 4, wherein said pea in said first chamber is sized relatively larger than said pea in said second chamber so that said relatively larger pea in said first chamber imparts a relatively deeper rumbling to said relatively lower whistle tone, and said relatively smaller pea in said second chamber imparts a relatively shrill staccato to said relatively higher whistle tone.

6. The emergency signaling whistle of claim 4, wherein said first and second barrel-shaped chambers which are mounted in end-to-end relationship have outer end walls which are configured to be gripped between a person's fingers.

7. The emergency signaling whistle of claim 6, wherein said outer end walls of said chambers have concave exterior grip surfaces which are generally cylindrically concave about axes which extend in a generally vertical direction when said mouthpiece is gripped in a person's mouth, so that said concave exterior grip surfaces are generally aligned with distal phalanges of a person's thumb and finger when said whistle is gripped by a person's mouth and hand.

8. The emergency signaling whistle of claim 7, wherein said grip surfaces each comprise:

surface texturing for enhancing a grip by a person's thumb and finger.

9. The emergency signalling whistle of claim 8, wherein said surfacing texturing is of a coarse diamond pattern which is configured to offer both an enhanced grip and a resistance to clogging by mud and snow.

10. An emergency signaling whistle comprising:

an elongate mouthpiece portion for being gripped in a person's teeth; and a drum portion for being held in a person's hand;

said mouthpiece portion comprising:

first and second air passages for receiving air which is blown from a person's mouth each said air passage having an exit slot for air to escape at an inner end thereof;

a first flange portion which extends outwardly around said mouthpiece portion such that a person's lips may form a substantially air-tight pressure seal against said first flange portion; and a second flange portion which extends at least upwardly and downwardly from an outer end of said mouthpiece portion by a sufficient distance to allow inwardly sloping inner surfaces of a person's incisors to engage said second flange portion without the need for fully clamping a person's incisors against said mouthpiece portion;

said second flange portion being spaced from said first flange portion by a predetermined distance such that a person's lips may seal against said first flange portion in response to said second flange portion being engaged by a person's incisors;

whereby said mouthpiece portion is held in a person's mouth with lips sealed against said first flange portion without using one's hands; and said barrel portion comprising:

first and second generally cylindrical chamber mounted in end-to-end relationships, each said chamber having an opening at an edge thereof across which air exiting said slot of said air passages is directed so as to produce a whistle tone, said first chamber being sized relatively larger so as to produce a whistle tone having a relatively lower first pitch so as to enable said whistle to be heard by persons at relatively long distances, and said second chamber being sized relatively smaller so as to produce a whistle tone having a relatively higher pitch so as to enable said whistle to be localized by persons at relatively short distances;

each said chamber having a pea received therein for imparting a warble to the whistle tone which is produced thereby, said pea in said first chamber being sized relatively larger than said pea in said second chamber;

said first and second chambers comprising outer end walls which are configured to be gripped between fingers of a person's hand, said end walls having grip surfaces which are generally cylindrically concave about axes which extend in a generally vertical direction when said mouthpiece portion is gripped in a person's mouth, so that said cylindrically concave grip surfaces are generally aligned with distal phalanges of a person's thumb and finger when said whistle is gripped by a person's mouth and hand;

said grip surfaces being provided with a coarse surface texture so as to enhance the grip which is offered thereby.

11. The emergency signaling whistle of claim 8, wherein said outer end walls of said chamber have a substantially constant thickness, so that said end walls have interior surfaces which are generally cylindrically convex about said vertically-extending axes, so as to form humps within said chambers past which said peas rotate so as to very a shape and effective volume of acoustic chambers which are formed within said barrel-shaped chambers, and so as to provide an increased rate of rotation and rattling of said peas in said barrel-shaped chambers which enhances the staccato effect imparted to said whistle tones.

12. The emergency signalling whistle of claim 6, wherein each said generally barrel-shaped chamber is generally oval-shaped in vertical cross-section, so that an acoustic chamber which is formed in said barrel-shaped chamber comprises:

a forward cupped wall portion; and a rearward cupped wall portion;

said cupped wall portions being oriented to generally face one another so that sound pressure waves are reflected within an interior of said acoustic chamber between said forward and rearward wall portions.

13. An emergency signaling whistle comprising:

a mouthpiece portion configured to be gripped by a person's incisors said mouthpiece portion comprising:

a first flange portion which extends outwardly around said mouthpiece portion such that a person's lips may form a substantially air-tight pressure seal against said first flange portion; and a second flange portion which extends at least upwardly and downwardly from an outer end of said mouthpiece portion by a sufficient distance to allow inwardly sloping inner surfaces of a person's incisor to engage said second flange portion without the need for fully clamping a person's incisors against said mouthpiece portion;

said second flange portion being spaced from said first flange portion by a predetermined distance such that a person's lips may seal against said first flange portion in response to said second flange portion being engaged by a person's incisors;

whereby said mouthpiece portion is held in a person's mouth with lips sealed against said first flange portion without using one's hands;

first and second air passages formed in said mouthpiece portion for receiving air which is blown from a person's mouth;

means associated with said first air passage for generating a whistle tone having a first pitch in response to flow of said air through said first passage;

means associated with said second air passage for generating a whistle tone having second pitch in response to flow of said air through said second passage;

said first pitch being relatively low so as to enable said whistle to be heard by persons at relatively long distances and said second pitch being relatively high so as to enable said whistle to be localized by persons at relatively short distances;

each said means associated with said air passages for generating said whistle tones comprising:

an exit slot at an end of said air passage; and a chamber mounted to said mouthpiece portion and having an opening across which said air from said exit slot is directed to produce said whistle tone;

a first of said chambers which is associated with said first passage being relatively larger so as to produce said whistle tone having said relatively lower first pitch, and a second of said chambers which is associated with said second passage being relatively smaller so as to produce said whistle tone having said relatively higher second pitch;

said first and second chambers being generally barrel-shaped and mounted transversely in end-to-end relationship at said ends of said air passages, said opening being formed along an edge of each said barrel-shaped chamber so that a portion of said air flowing through said passages enters therein;

a pea member received in each said barrel-shaped chamber for imparting a warble to said whistle tone which is produced by said chamber, said pea in said first chamber being sized relatively larger than said pea in said second chamber so that said relatively larger pea in said first chamber imparts a relatively deeper rumbling to said relatively lower whistle tone, and said relatively smaller pea in said second chamber imparts a relatively shrill staccato to said relatively higher whistle tone;

each said generally barrel-shaped chamber being generally oval-shaped in vertical cross-section, so that an acoustic chamber which is formed by said barrel-shaped chamber comprises:

a forward cupped wail portion; and a rearward cupped wall portion;

said cupped wall portions being oriented to generally face one another so that sound pressure waves are reflected within an interior of said acoustic chamber between said forward and rearward wall portions;

said first and second barrel-shaped chambers having outer end walls with exterior grip surfaces which are generally cylindrically concave about axes which extend in a generally vertical direction when said mouthpiece is gripped in a person's mouth, so that cylindrical concave grip surfaces are generally aligned with distal phalanges of a person's thumb and finger when said whistle is gripped by a person's mouth and hand, said grip surfaces being provided with surface texturing for enhancing a grip which is offered thereby;

said outer end walls of said chambers having a substantially constant thickness, so that said end walls have interior surfaces which are generally cylindrically convex about said vertically-extending axes, so as to form humps within said chambers past which said peas rotate so as to vary a shape and effective volume of said acoustic chambers which are formed within said barrel-shaped chambers, and so as to provide an increased rate of rotation and rattling of said peas in said barrel-shaped chambers which enhances the staccato effect imparted to said whistle tones.

* * * * *